US011508346B2

(12) United States Patent
Shelton et al.

(10) Patent No.: US 11,508,346 B2
(45) Date of Patent: Nov. 22, 2022

(54) MINIATURE ULTRASONIC TRANSDUCER PACKAGE

(71) Applicant: Invensense, Inc., San Jose, CA (US)

(72) Inventors: Stefon Shelton, Berkeley, CA (US); Andre Guedes, Berkeley, CA (US); David Horsley, Berkeley, CA (US)

(73) Assignee: InvenSense, Inc., San Jose, CA (US)

( * ) Notice: Subject to any disclaimer, the term of this patent is extended or adjusted under 35 U.S.C. 154(b) by 1044 days.

(21) Appl. No.: 15/987,824

(22) Filed: May 23, 2018

(65) Prior Publication Data

US 2018/0268796 A1 Sep. 20, 2018

Related U.S. Application Data

(63) Continuation of application No. PCT/US2015/063242, filed on Dec. 1, 2015.

(51) Int. Cl.
*G10K 9/22* (2006.01)
*G10K 9/122* (2006.01)

(52) U.S. Cl.
CPC ..... *G10K 9/22* (2013.01); *G10K 9/122* (2013.01)

(58) Field of Classification Search
CPC ..... G10K 9/22; G10K 9/122
See application file for complete search history.

(56) References Cited

U.S. PATENT DOCUMENTS 7,982,369 B2 * 7/2011 Ona ..... B06B 1/0622 310/334
8,327,521 B2 12/2012 Dirksen et al.
8,948,420 B2 2/2015 Doller et al.
9,226,079 B2 12/2015 Sciutti et al.
10,092,270 B2 10/2018 Dirksen
10,123,112 B2 11/2018 Murgia et al.
2003/0114760 A1 * 6/2003 Robinson ..... B06B 1/0692 600/459
2005/0075572 A1 * 4/2005 Mills ..... B06B 1/0292 600/459

(Continued)

FOREIGN PATENT DOCUMENTS

CN 102430512 A 2/2012
CN 101969856 B 6/2013

(Continued)

OTHER PUBLICATIONS

Official Communication dated Oct. 13, 2021 for application No. EP15909912.6.

(Continued)

*Primary Examiner* — Mohamed Barakat

(57) ABSTRACT

A package design for a micromachined ultrasound transducer (MUT) utilizing curved geometry to control the presence and frequency of acoustic resonant modes is described. The approach consists of reducing in number and curving the reflecting surfaces present in the package cavity to adjust the acoustic resonant frequencies to locations outside the band of interest. The design includes a cavity characterized by a curved geometry and a MUT mounted to a side of a substrate facing the cavity with a sound emitting portion of the MUT facing an opening in the substrate. The substrate is disposed over an opening of the cavity with the substrate oriented such that the MUT located within the cavity.

27 Claims, 4 Drawing Sheets

(56) References Cited

U.S. PATENT DOCUMENTS

| | | | | |
|---|---|---|---|---|
| 2010/0207485 | A1 | 8/2010 | Dirksen et al. | |
| 2012/0010538 | A1 | 1/2012 | Dirksen | |
| 2013/0034257 | A1 | 2/2013 | Doller et al. | |
| 2013/0049526 | A1 | 2/2013 | Chung | |
| 2013/0051178 | A1* | 2/2013 | Rybyanets | A61N 7/02 367/138 |
| 2014/0286509 | A1 | 9/2014 | Sciutti et al. | |
| 2017/0215846 | A1 | 8/2017 | Sammoura et al. | |
| 2018/0108338 | A1* | 4/2018 | Klemm | G01S 7/52079 |

FOREIGN PATENT DOCUMENTS

| | | | |
|---|---|---|---|
| IT | TO20130225 | A1 | 9/2014 |
| JP | 2009182838 | A | 8/2009 |
| KR | 101689346 | B1 | 12/2016 |
| WO | 2009096576 | A2 | 8/2009 |
| WO | 2015112453 | A1 | 7/2015 |

OTHER PUBLICATIONS

Extended European Search Report dated Jul. 17, 2019 for application No. EP15909912.6.

(Daush et al.) Theory and Opertation of 2-D Array Piezoelecliic Micromachined Ultrasound Transducers IEEE Transactions on Ultrasonics, Ferroelectronics, and Frequency Control, vol. 55, No. Nov. 11, 2008.

International Search Report and Written Opinion dated Apr. 7, 2016 for International Patent Application No. PCT/US2015/063242.

* cited by examiner

MINIATURE ULTRASONIC TRANSDUCER PACKAGE

CLAIM OF PRIORITY

This application is a continuation of International Patent Application Number PCT/US15/63242 filed Dec. 1, 2015, the entire contents of which are incorporated herein by reference.

STATEMENT REGARDING FEDERALLY SPONSORED RESEARCH OR DEVELOPMENT

This invention was made with Government support under IIP-1346158 awarded by the National Science Foundation. The Government has certain rights in this invention. 45 CFR 650.4(f)(4)

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

CLAIM OF PRIORITY

This application is a continuation of International Patent Application Number PCT/US2016/063242, filed Dec. 1, 2015, the entire contents of which are incorporated herein by reference.

FIELD OF THE DISCLOSURE

The present disclosure generally relates to packaging for micromachined ultrasonic transducers (MUTs) and more particularly to packaging design for a micromachined ultrasonic transducer implementing a design of the back cavity using curved surfaces to control the resonant acoustic modes of the cavity, thereby increasing transducer performance.

BACKGROUND OF THE DISCLOSURE

Micromachined ultrasonic transducers (MUTs), and more specifically piezoelectric MUTs (pMUTs), typically consist of a released membrane structure operated at resonance and enclosed on one side by the package. In this type of structure, the design of the back-cavity on the enclosed side of the membrane has a strong effect on transducer performance, particularly the output pressure and bandwidth. Because typical packaging dimensions for MUTs are on the order of a wavelength for transducers operating at ultrasonic frequencies, standing waves are generated in the package back-cavity giving rise to acoustic resonant modes. With a traditional rectangular cavity, there are 3 degrees of freedom and multiple acoustic resonance modes in the x, y, and z dimensions as well as combination modes. The plurality of package acoustic resonance modes, if located at the incorrect frequency, can significantly reduce the output pressure and bandwidth of the transducer. In order to ensure device performance across a range of frequencies and temperatures, a method of controlling the resonant modes of the cavity is required. This invention describes a design for reducing the number of resonant modes in the back cavity of a MUT package using curved geometry to enable consistent acoustic performance of the packaged transducer.

SUMMARY

Aspects of this disclosure relate to the package design for a pMUT utilizing curved geometry to control the presence and frequency of acoustic resonant modes in the back cavity of the transducer package. The approach consists of reducing in number and curving the reflecting surfaces present in the package cavity. Utilizing, by way of example, cylindrical or spherical geometry the resonant acoustic modes present in the package are reduced and can be adjusted to frequencies outside the band of interest.

BRIEF DESCRIPTION OF THE FIGURES

The present disclosure may be better understood by reference to the following drawings which are for illustrative purposes only.

DETAILED DESCRIPTION

Although the description herein contains many details, these should not be construed as limiting the scope of the invention but as merely providing illustrations of some of the presently preferred embodiments of this invention. Therefore, it will be appreciated that the scope of the present invention fully encompasses other embodiments, which may become obvious to those skilled in the art.

Aspects of this disclosure include a micromachined ultrasonic transducer (MUT) package, in particular a pMUT package comprised of a curved cavity to reduce the number of resonance modes present in the back cavity of a pMUT package. It will be appreciated that the following embodiments are provided by way of example only, and that numerous variations and modifications are possible. For example, while cylindrical and hemispherical embodiments are shown, the back cavity may have many different shapes utilizing curved geometry. Furthermore, while pMUTs are shown in this description, other MUTs should also be considered, such as capacitive micromachined ultrasonic transducers (cMUTs) or optical acoustic transducers. All such variations that would be apparent to one of ordinary skill in the art are intended to fall within the scope of this disclosure. It will also be appreciated that the drawings are not necessarily to scale, with emphasis being instead on the distinguishing features of the package with curved geometry for a pMUT device disclosed herein.

Figure 1:
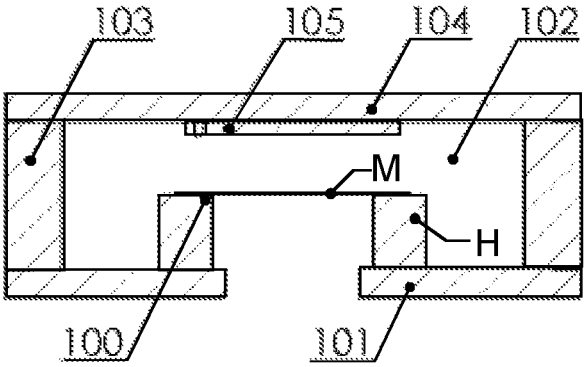
FIG. 1 shows a cross section of an ultrasonic transducer package having a cylindrical back-cavity in accordance with an aspect of the present disclosure.
Figure 2:
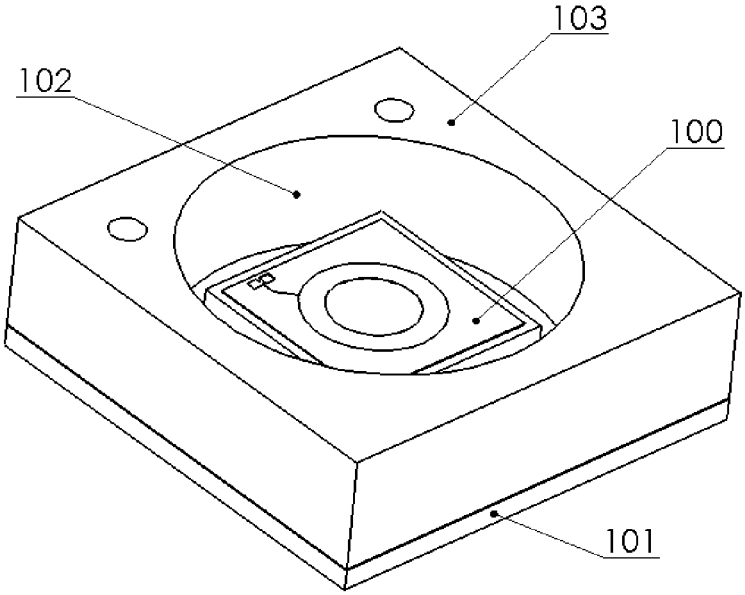
FIG. 2 is an isometric view of an ultrasonic transducer package having a cylindrical back-cavity in accordance with an aspect of the present disclosure.

FIG. 1 is a cross-section illustration of a cylindrical embodiment of the proposed pMUT package. In this embodiment the thin membrane pMUT 100 is mounted to a substrate 101 with a port hole for the sound to enter and exit. The pMUT 100 includes a membrane M attached to a structure referred to as a handle H, which is attached to the substrate 101 with the handle between the membrane and the substrate. The handle H includes an opening aligned with the port hole in the substrate 101. The cylindrical back-cavity 102 portion of the package may be enclosed by a protective lid composed of a spacer 103 and bottom substrate 104. Spacer 103 and bottom substrate 104 may be formed from laminate material such as FR-4 or BT (Bismaleimide/Triazine). Spacer 103 has a curved, e.g., circular or nearly circular or ellipsoidal hole which forms a curved cylindrical, e.g., circular or nearly circular or ellipsoidal cylindrical cavity for the transducer to sit in, as illustrated in FIG. 2. The bottom substrate 104 is then used to complete the cylindrical geometry. In some embodiments, the protective lid may be made from a single piece and composed of stamped or formed metal or a molded polymer such as liquid crystal polymer (LCP). The radius of the cylindrical back-cavity is in the range of 0.2 mm to 5 mm, and more specifically 0.3 mm to 2.5 mm, for transducers operating at frequencies from 100 kHz to 600 kHz. Similarly, the height of the cylindrical back-cavity is in the range from 0.1 mm to 2 mm and more specifically in the range from 0.4 mm to 1 mm.

In an embodiment, an application specific integrated circuit (ASIC) 105 may be mounted on bottom substrate 104 and electrical connections to the ASIC 105 and pMUT 100 may be provided through the bottom substrate 104, a configuration that is known as a top-port package since the acoustic port hole is located on substrate 101 opposite the bottom substrate 104. In other embodiments, the electrical connections may be provided through substrate 101, a configuration known as a bottom-port package since the electrical connections and the acoustic port are both located on a common substrate 101.

Figure 3:
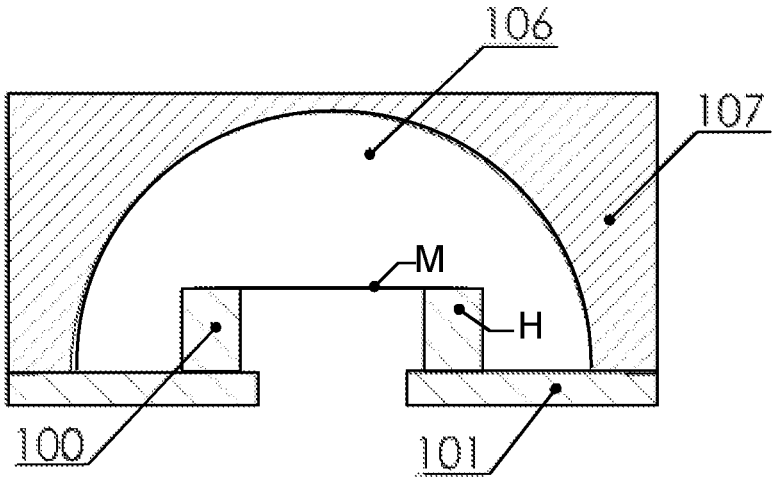
FIG. 3 shows a cross section of an ultrasonic transducer package having a hemispherical back-cavity in accordance with an aspect of the present disclosure.

FIG. 3 shows a cross-section illustration of a hemispherical embodiment of the proposed package. In this embodiment, a pMUT 100 is mounted to a substrate 101 with a port hole for the ultrasound to enter and exit. The pMUT 100 includes a membrane M attached to a structure referred to as a handle H, which is attached to the substrate 101 with the handle between the membrane and the substrate. The handle H includes an opening aligned with the port hole in the substrate 101. A back-cavity 106 in this case is a hemisphere formed by a protective lid 107 which may be comprised of a metal, laminate, plastic, or other material.

Figure 4:
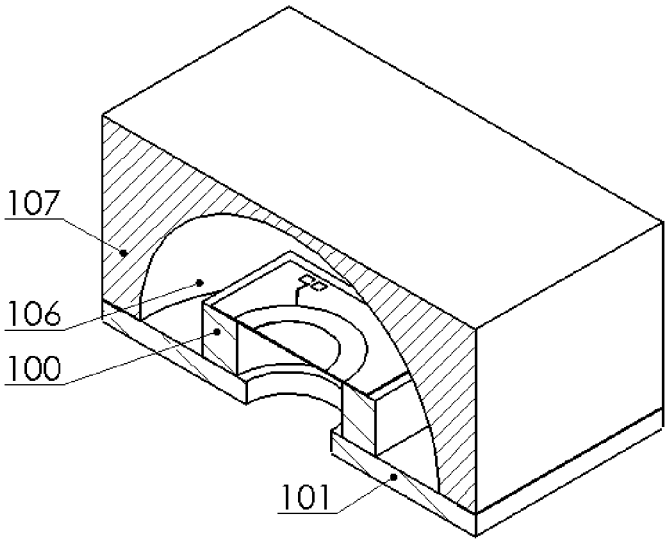
FIG. 4 is an isometric view of an ultrasonic transducer package having a hemispherical back-cavity in accordance with an aspect of the present disclosure.

FIG. 4 shows a cut-away view of a hemispherical embodiment of a package. The radius of the hemispherical back-cavity is in the range of 0.2 mm to 3 mm, and more specifically 0.3 mm to 2 mm, for transducers operating at frequencies from 100 kHz to 600 kHz.

Given that typical packaging dimensions for MUTs are on the order of a wavelength at ultrasonic frequencies, standing wave patterns are generated in the package cavity that result in acoustic resonant modes. With a traditional rectangular cavity, there are 3 degrees of freedom and multiple acoustic resonance modes in the x, y, and z dimensions as well as combination modes.

Figure 5:
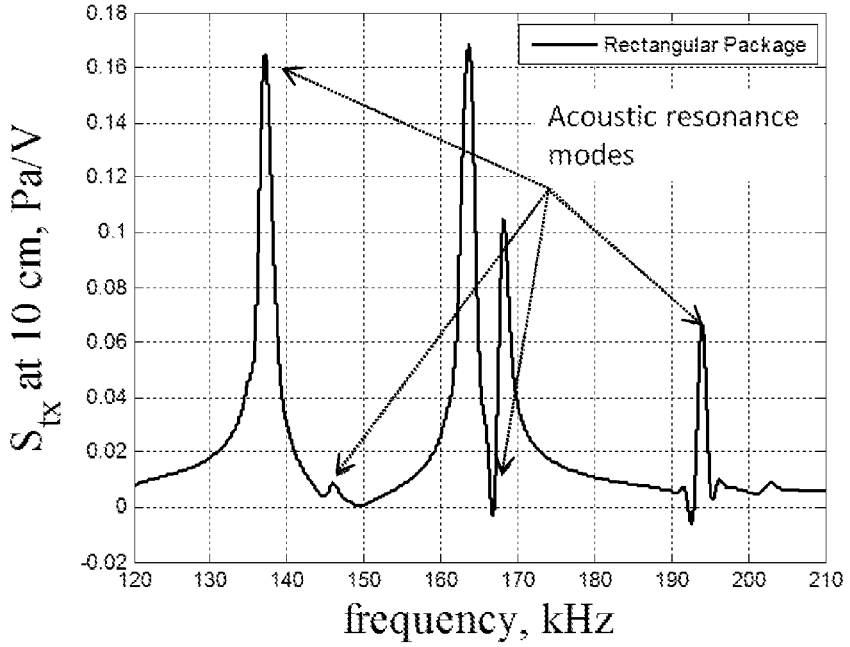
FIG. 5 shows the acoustic frequency response of a pMUT with a 165 kHz operating frequency that is packaged in an ultrasonic transducer package with a rectangular back-cavity.
Figure 6:
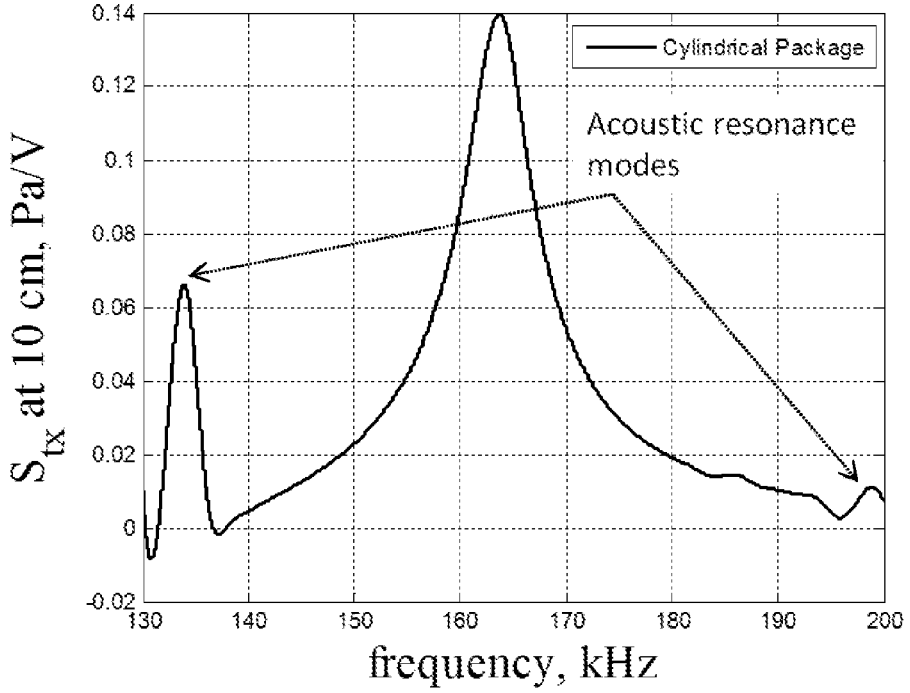
FIG. 6 shows the acoustic frequency response of a pMUT with a 165 kHz operating frequency that is packaged in an ultrasonic transducer package with a cylindrical back-cavity.
Figure 7:
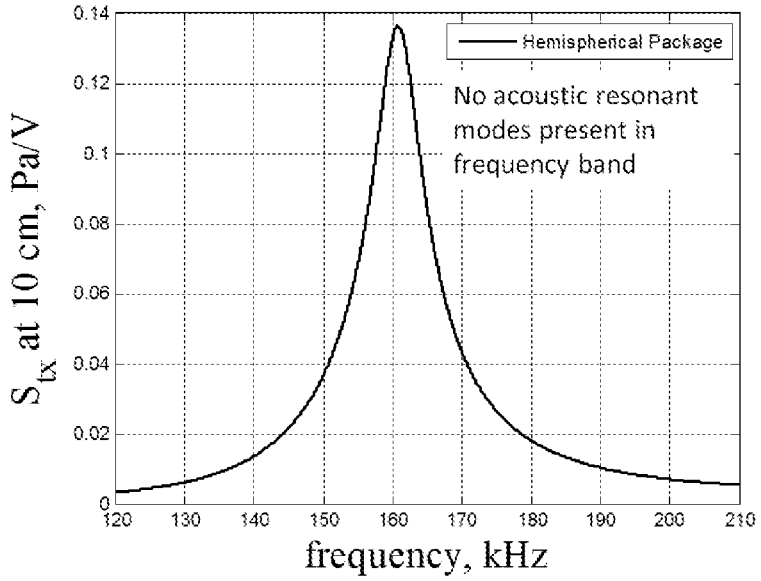
FIG. 7 shows the acoustic frequency response of a pMUT with a 165 kHz operating frequency that is packaged in an ultrasonic transducer package with a hemispherical back-cavity.
Figure 8:
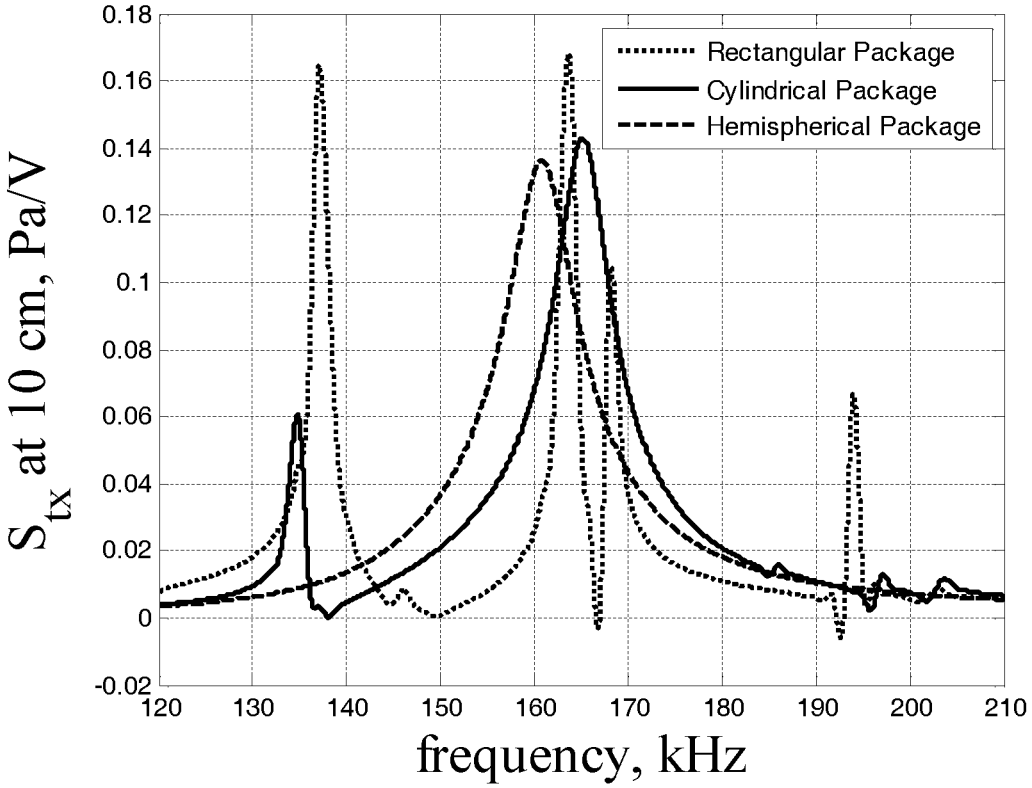
FIG. 8 shows the acoustic frequency response of a pMUT with a 165 kHz operating frequency comparing the response when the back-cavity is rectangular, cylindrical, and hemispherical.

Back-cavities with rectangular geometry possess many different acoustic modes due to the plurality of reflecting surfaces. By way of example, but not limitation, the simulated acoustic frequency response of a 165 kHz pMUT packaged with a rectangular back-cavity is shown in FIG. 5. The transmit sensitivity (Pa/V), which is a measure of the output pressure per input volt, is calculated at 10 cm from the substrate port opening. When operating at the resonance frequency of the back-cavity, energy is transferred preferentially into the back-cavity resonance mode, causing the output pressure of the transducer to drop and having a deleterious effect on the transducer's frequency and time response. In this design example there are 4 acoustic resonance modes present in the back-cavity, one of which is at a frequency near the pMUT's 165 kHz resonance frequency. Because there are three other modes that lie at frequencies below (~137 kHz and ~146 kHz) and above (~195 kHz) the pMUT's 165 kHz operating frequency, it is very difficult to design a rectangular back-cavity where the acoustic resonance modes do not interfere with the PMUT's operating frequency, particularly when the effects of temperature on the resonance modes are taken into consideration. By curving the back-cavity geometry we reduce the number of acoustic paths that give rise to resonances thus flattening the acoustic frequency response. By way of example, but not limitation, cylindrical geometry reduces the number of degrees of freedom from three (xyz) to two (radius and height), thereby reducing the number of acoustic resonances in a given frequency band. FIGS. 6 and 7 show the acoustic frequency response for a 165 kHz pMUT with cylindrical and spherical back-cavities. It can be clearly seen that the number of acoustic resonances is significantly reduced for both geometries and any remaining modes are widely spaced in frequency. FIG. 8 shows a comparison between the frequency response of the ultrasonic transducer packaged with rectangular, cylindrical, and hemispherical back-cavities. The frequency response of the transducer packaged with a rectangular back-cavity exhibits an undesired null near 165 kHz whereas the transducer packaged with a cylindrical or hemispherical back-cavity shows the desired acoustic response at the pMUT's resonant frequency (~165 kHz) with a full-width-at-half-maximum (FWHM) bandwidth of 10 kHz. This figure demonstrates that by carefully choosing the radius and height of the cylindrical cavity, we can shift the frequency of the back-cavity's acoustic resonance modes so that they do not interfere with the pMUT's operating frequency. Similarly, for the hemispherical embodiment, by careful selection of the hemispherical back-cavity's radius we can control the frequency of the resonant modes and locate them at frequencies chosen to enhance transducer performance.

All cited references are incorporated herein by reference in their entirety. In addition to any other claims, the applicant (s)/inventor(s) claim each and every embodiment of the invention described herein, as well as any aspect, component, or element of any embodiment described herein, and any combination of aspects, components or elements of any embodiment described herein.

The appended claims are not to be interpreted as including means-plus-function limitations, unless such a limitation is explicitly recited in a given claim using the phrase "means for." Any element in a claim that does not explicitly state "means for" performing a specified function, is not to be interpreted as a "means" or "step" clause as specified in 35 USC § 112, ¶6. In particular, the use of "step of" in the claims herein is not intended to invoke the provisions of 35 USC § 112, ¶6.

What is claimed is:

1. A micromachined ultrasound transducer (MUT) package, comprising:

a cavity characterized by a curved geometry; and a MUT mounted to a side of a substrate facing the cavity with an ultrasonic wave emitting portion of the MUT facing an aperture in the substrate, wherein the substrate is disposed over an opening of the cavity with the substrate oriented such that the MUT is located within the cavity and wherein at least a radius of the curved geometry of the cavity is chosen such that acoustic resonance modes of the cavity do not interfere with an operating frequency of the MUT, wherein the MUT includes a membrane attached to a handle, wherein the handle is between the membrane and the substrate and the handle has an opening aligned with the opening in the substrate.

2. The apparatus of claim 1, wherein the cavity is characterized by a cylindrical geometry.

3. The apparatus of claim 2, wherein the cavity is characterized by a circular cylindrical geometry.

4. The apparatus of claim 3, wherein the cavity is characterized by a circular cylindrical geometry characterized by a cylinder radius of between 0.2 mm and 5 mm.

5. The apparatus of claim 4, wherein the cylinder radius is between 0.3 mm and 2.5 mm.

6. The apparatus of claim 5, wherein the MUT is configured to operate at a frequency between 100 kHz and 600 kHz.

7. The apparatus of claim 4, wherein the cylindrical geometry is further characterized by a cylinder height in a range from 0.1 mm to 2 mm.

8. The apparatus of claim 4, wherein the cylinder height is in a range from 0.4 mm to 1 mm.

9. The apparatus of claim 3, wherein the radius and a height of the cavity are configured such that acoustic resonance modes of the cavity do not interfere with the MUT's operating frequency.

10. The apparatus of claim 2, wherein the MUT is centered with respect to a cylindrical symmetry axis of the cavity.

11. The apparatus of claim 2, wherein the substrate is a top substrate and the cavity is formed by a spacer sandwiched between the top substrate and a bottom substrate, the spacer having a cylindrical opening formed therethrough.

12. The apparatus of claim 11, wherein the MUT is mounted to a top substrate to completely cover an aperture in the top substrate, wherein the aperture is smaller than the opening of the cavity.

13. The apparatus of claim 12, wherein an application specific integrated circuit (ASIC) is mounted to a bottom substrate and a plurality of electrical connections are made to the ASIC through the bottom substrate.

14. The apparatus of claim 2, wherein the substrate is a bottom substrate and the cavity is formed by a lid having a cylindrical cavity.

15. The apparatus of claim 14, wherein the MUT is mounted to the bottom substrate to completely cover an aperture in the substrate.

16. The apparatus of claim 15, wherein an application specific integrated circuit (ASIC) is mounted alongside the MUT on a bottom substrate.

17. The apparatus of claim 14, wherein the MUT is mounted inside the lid to completely cover an aperture in the lid.

18. The apparatus of claim 17, wherein an application specific integrated circuit (ASIC) is mounted to a bottom substrate and a plurality of electrical connections are made to the ASIC through the bottom substrate.

19. The apparatus of claim 1, wherein the cavity is characterized by a hemispherical geometry.

20. The apparatus of claim 19, wherein the MUT is centered with respect to a hemispherical symmetry axis of the cavity.

21. The apparatus of claim 19, wherein the hemispherical geometry is characterized by a hemispherical radius between 0.2 mm and 3 mm.

22. The apparatus of claim 19, wherein the hemispherical radius is between 0.3 mm and 2 mm.

23. The apparatus of claim 19, wherein the MUT is configured to operate at a frequency between 100 kHz and 600 kHz.

24. The apparatus of claim 1, wherein the ultrasonic wave emitting portion of the MUT includes a membrane disposed over an opening in a MUT substrate.

25. The apparatus of claim 1, wherein the MUT is a piezoelectric micromachined ultrasound transducer (pMUT).

26. The apparatus of claim 1, wherein the MUT is a capacitive micromachined ultrasonic transducer (cMUT).

27. A micromachined ultrasound transducer (MUT) package, comprising:

a substrate;

a cavity formed by a lid and the substrate and characterized by a curved geometry; and a MUT mounted within the cavity with an ultrasonic wave emitting portion of the MUT facing an aperture in the substrate, wherein the MUT includes a membrane attached to a handle, wherein the handle is between the membrane and the substrate and the handle is disposed over the aperture;

wherein at least a radius of the curved geometry of the cavity is chosen such that acoustic resonance modes of the cavity do not interfere with an operating frequency of the MUT.

* * * * *